United States Patent [19]

Sedgwick

[11] 3,956,886

[45] May 18, 1976

[54] FLAME TUBES FOR GAS TURBINE ENGINES

[75] Inventor: Gordon Sedgwick, Nelson, England

[73] Assignee: Joseph Lucas (Industries) Limited, Birmingham, England

[22] Filed: Dec. 7, 1973

[21] Appl. No.: 422,844

[52] U.S. Cl. ..... 60/39.69; 60/39.32

[51] Int. Cl.[2] ..... F02G 1/00

[58] Field of Search ..... 60/39.69, 39.65; 138/113; 431/352

[56] References Cited

UNITED STATES PATENTS

| | | | |
|---|---|---|---|
| 2,544,538 | 3/1951 | Mahnken et al. | 60/39.69 |
| 2,547,619 | 4/1951 | Buckland | 60/39.65 |
| 2,617,255 | 11/1952 | Niehus | 60/39.65 |
| 2,686,655 | 8/1954 | Schorner | 60/39.65 |
| 2,913,873 | 11/1959 | Murray | 60/39.69 |
| 2,915,877 | 12/1959 | Darling | 60/39.39 |
| 2,955,415 | 10/1960 | Long | 60/39.39 |
| 3,352,106 | 11/1967 | Planko | 60/39.65 |
| 3,353,359 | 11/1967 | Webb | 60/265 |
| 3,594,109 | 7/1971 | Penny | 60/39.65 |
| 3,854,503 | 12/1974 | Nelson et al. | 60/39.65 |

*Primary Examiner*—Samuel Feinberg
*Attorney, Agent, or Firm*—Holman & Stern

[57] ABSTRACT

A flame tube for a gas turbine engine comprises an annular casing within which is disposed a plurality of rings of silicon nitride tiles. The tiles are arranged in axially extending rows and are located by means of a tongue and groove arrangement. The tiles in each row are urged into mutual engagement by a clamp arrangement at one end of the row and an abutment surface fixed relative to the casing at the other end of the row.

10 Claims, 6 Drawing Figures

FLAME TUBES FOR GAS TURBINE ENGINES

BACKGROUND OF INVENTION

This invention relates to flame tubes for gas turbine engines.

SUMMARY OF THE INVENTION

According to the present invention, there is provided a flame tube for a gas turbine engine which is at least partially formed by a plurality of ceramic rings, said rings being composed of a plurality of ceramic tiles.

Preferably, the ceramic tiles are formed of silicon nitride.

Advantageously, the tiles are located in position by a tongue and groove arrangement between the tiles and a casing surrounding said tiles. In one form, the tongue and groove arrangement is provided on a centre line of the tiles or, in another form, the tongue and groove arrangement is offset from the centre line of the tiles.

However, in a preferred arrangement, the tiles are provided with integral tongues at the ends thereof, and abutting tongues of peripherally adjacent tiles engage in different portions of the same groove.

It is preferred to arrange the grooves to be defined by configurated metal plates secured to an inner surface of said casing.

Most preferably, the ceramic rings are disposed in a side-by-side row extending longitudinally of the flame tube so that the tiles in the respective rings are in longitudinally aligned rows, there being provided abutment means between the casing and an end of each tile row and clamping means serving to urge each tile row against its respective abutment means.

The invention is particularly applicable to annular flame tubes where radially inner and outer rows of ceramic rings of tiles are provided. In such an annular flame tube arrangement, there may be provided two rings of half U-shaped ceramic tiles which interconnect the inner and outer rows of ceramic tiles at one end thereof, at least some of the half U-shaped ceramic tiles being provided with aligned recesses therein defining apertures therethrough to accommodate fuel atomiser nozzles which are, most advantageously, of the fan-shaped spray type.

The half U-shaped ceramic tiles may be located in position by the clamping means used to locate the rows of tiles, each clamping means being adapted to locate an inner row of tiles and a corresponding outer row of tiles.

Preferably, each abutment means and the tile in engagement therewith have mutually contacting surfaces which lie on straight lines emanating from a single point on the annular flame tube axis so that relative longitudinal movement between the row of tiles and the casing causes the surfaces to slide relative to one another whereby the clamping force on the row of tiles is maintained substantially constant.

In the preferred arrangement, the inner and outer rows of tiles are inter-connected at one end by an annular ceramic ring having a series of angularly spaced apertures therethrough to receive fuel atomiser nozzles.

At the opposite end of the outer rows of tiles, there may be provided a further annular ceramic ring having a curved inner wall defining the outer wall of an annular outlet, and a clamping means acts on said further annular ceramic ring to urge the latter into abutment with the outer rows of tiles.

At the opposite end of the inner rows of rings, one of the abutment means may be defined by a composite ceramic annulus having an inwardly facing recess engaged around an annular rim on an inner wall of the casing, the abutment means on said annulus having a frusto-conical, tile engaging surface whose notional apex is disposed at a point on the flame tube axis which is in a plane in which lie the mutually engaging surfaces of the apertured annular ceramic ring and the adjacent tiles of the inner rows, the clamping means for the inner rows of tiles acting thereupon through the intermediary of the apertured annular ceramic ring.

Preferably also, the clamping means for the outer rows of tiles comprises a member having a frusto-conical surface engaging a corresponding surface on the said further annular ceramic ring, the frusto-concial surface having a notional apex disposed at a point on the flame tube axis which is in a plane in which lie the mutually engaging surfaces of the abutment means and the adjacent tiles of the outer rows.

Embodiments of the present invention will now be described, by way of example, with reference to the accompanying drawings, in which:

DETAILED DESCRIPTION OF THE EMBODIMENTS

Figure 1:
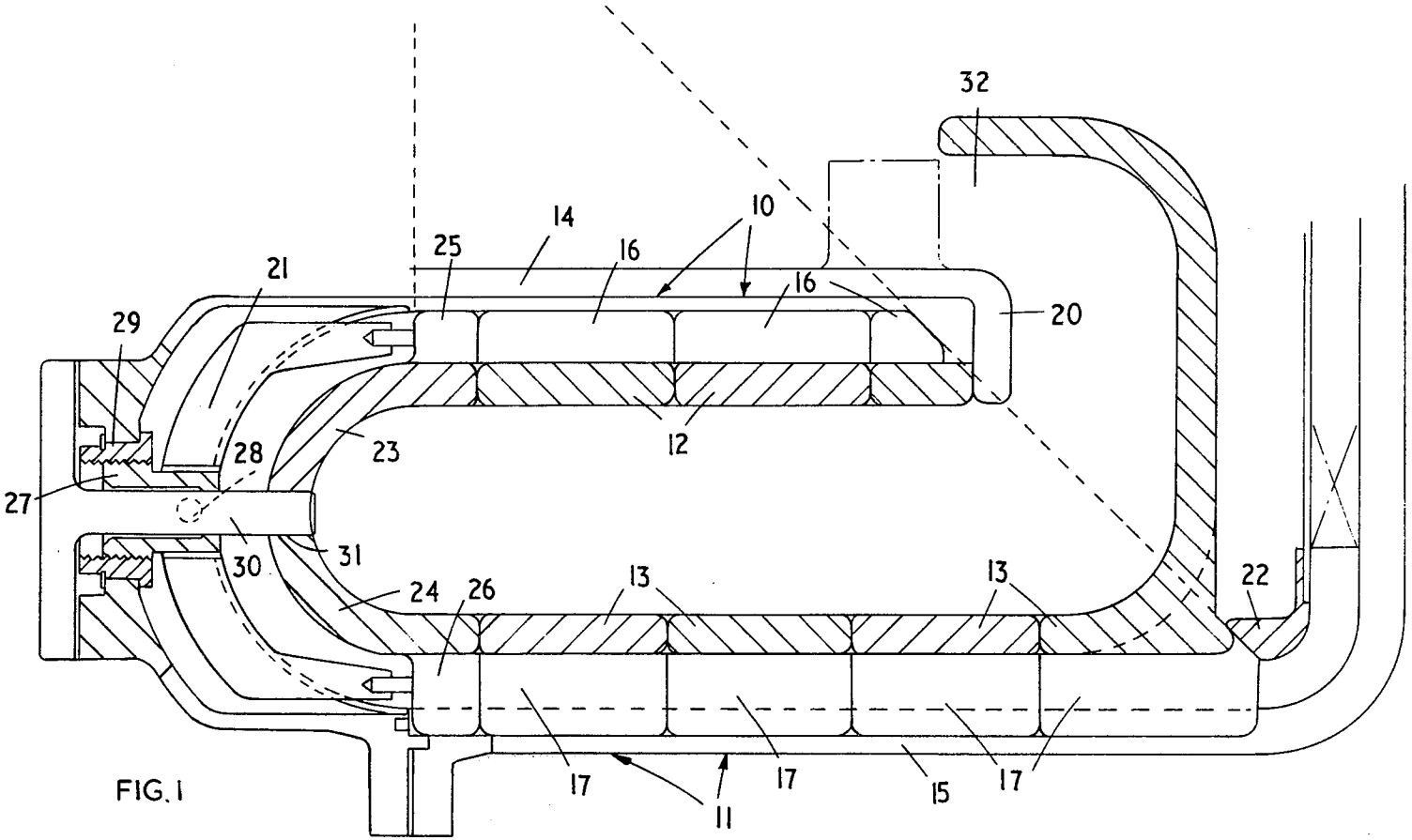
FIG. 1 is a longitudinal sectional view of part of an annular flame tube according to the present invention.
Figure 2:
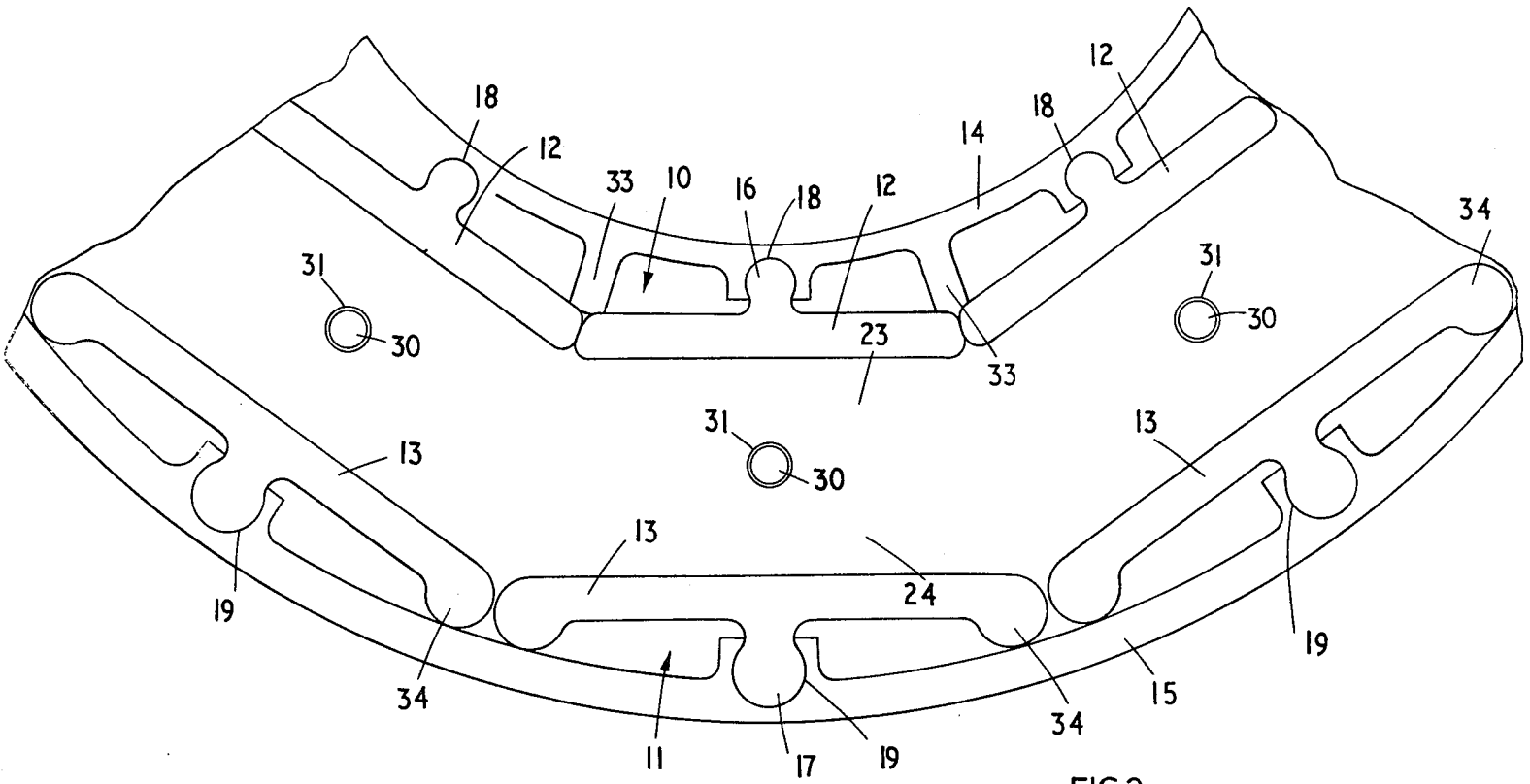
FIG. 2 is a view of part of the flame tube of FIG. 1 on the arrow A in FIG. 1.

Referring to FIGS. 1 and 2 of the drawings, the flame tube comprises a plurality of radially inner and outer silicon nitride rings 10 and 11 which are each formed of a plurality of tiles 12 and 13. The inner and outer rings 10 and 11 are mounted, respectively, on inner and outer casing walls 14 and 15 in such a manner that the inner and outer rings 10 and 11 define inner and outer side-by-side rows extending longitudinally of the flame tube so that the tiles 12 and 13, respectively, in the respective rows are in longitudinally aligned rows. As can be seen from FIG. 2, each tile 12, 13 is provided with a respective tongue 16, 17 engaged in longitudinally extending grooves 18, 19, respectively. The arrangement is such that each row of inner tiles 12 in a particular groove 18 is urged towards an abutment 20 on the inner casing wall 14 by a yoke 21 which also serves to urge a corresponding outer row of tiles 13 in a particular groove 19 against a corresponding abutment 22 on the outer casing wall 15. Each yoke 21 acts on the respective rows of tiles 12 and 13 through the intermediary of a pair of inner and outer half U-shaped tiles 23, 24 provided respectively with tongues 25, 26 which are engaged in the respective grooves 18 and 19. Each yoke 21 is attached to an externally screw-threaded bush 27 via a pivot 28. The bush 27 co-operates with an internally screw-threaded sleeve 29 which can be rotated relative to the casings 14 and 15 to move the yoke 21 relative thereto. Each bush 27 accommodates a fuel atomiser nozzle assembly 30 which extends into the flame tube through an aperture 31 defined by a pair of aligned recesses in the respective tiles 23 and 24. Each nozzle assembly 30 is adapted to provide a fan-shaped fuel spray pattern within the flame tube, in use. The tiles 13 of the ring 11 adjacent to the abutment 22 are each of generally U-shaped form so as to define an annular outlet 32 for the flame tube. As can be seen from FIG. 1, each U-shaped tile 13 and its corresponding abutment 22 engage each other along surfaces which are inclined with respect to a radius of the flame tube. The arrangement of the mutually engaging surfaces is such that relative movement between the casing 15 and a particular longitudinal row of tiles 13 causes the said mutually engaging surfaces to slide relative to one another whereby the clamping force exerted by the yoke 21 is maintained substantially constant during the working conditions prevailing in the flame tube. Such an effect is obtained by arranging the mutually engaging surfaces of each U-shaped tile 13 and its corresponding abutment 22 to be in the same plane as the mutually engaging surfaces of the end tile 12 in the opposite inner row and the corresponding abutment 20, by arranging the yoke contacting surfaces of the tongues 25 and 26 of each row to be in the same plane, and by arranging the two aforesaid planes for any particular row to intersect on the axis of the annular combustion chamber. In this manner the surfaces between the tiles 13 and abutments 22, the tiles 12 and abutments 20, and between the tiles 12 and 13 and the yokes 21 all lie on straight lines emanating from a single point on the flame tube axis.

As can be seen from FIG. 2, each inner tile 12 is of substantially planar shape and rests at its ends on chamfered projections 33 extending from the inner casing wall 14. Each projection 33 is shared by the adjacent ends of two abutting tiles 12. Each outer tile 13 is provided with ends 34 abutting against the internal surface of the casing wall 15 so that the tile 13 is located in position by the end 34 and the tongue 17 which is located on the centre line of the tile 13.

Figure 3:
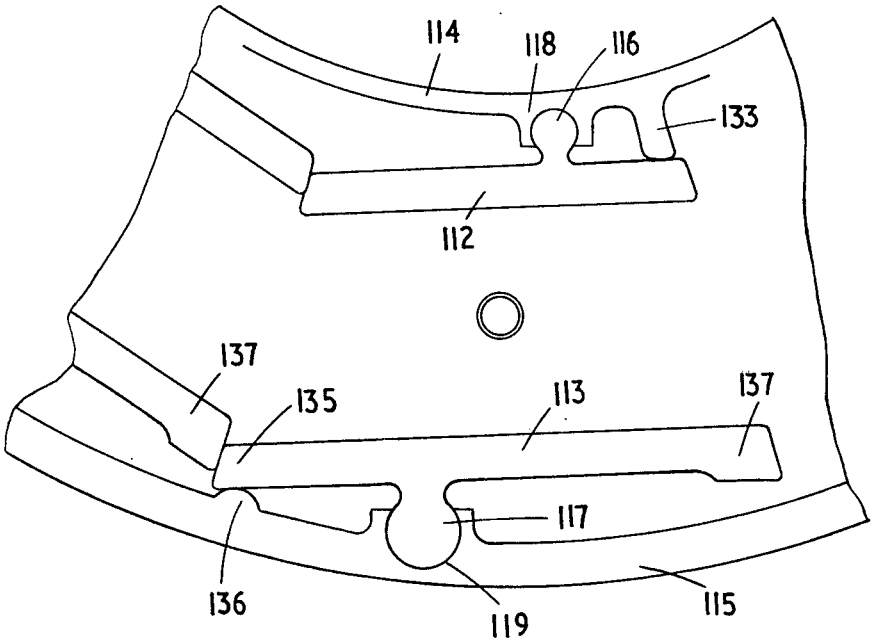
FIG. 3 is a view similar to FIG. 2 showing an alternative embodiment of a flame tube according to the present invention.

Referring now to FIG. 3 of the drawings, there is shown an alternative tile arrangement to that shown in FIGS. 1 and 2. In FIG. 3, each inner tile 112 is formed of silicon nitride with an integral tongue 116 which engages in a longitudinally extending groove 118 in an inner casing wall 114 in a similar manner to the inner tiles 12 in the embodiment of FIGS. 1 and 2. In this embodiment, however, the tongue 116 is offset from the centre line of each tile 112 and only one projection 133 is provided for supporting an end of the tile 112. The projection 133 engages that end of the tile 112 which is closest to the tongue 116. The opposite end of each tile 112 is chamfered and engages a corresponding chamfered end of an adjacent tile 112 whose other end rests against a further projection 133.

In a similar manner to the tiles 112, each outer tile 113 is formed of silicon nitride and is provided with an integral tongue 117 which engages in a longitudinally extending groove 119 formed in an outer casing wall 115. An end 135 of each tile 113 rests against a projection 136 on the casing wall 115. The opposite end 137 of each tile 133 is located further from the tongue 117 than the end 135 and is chamfered to abut against the end 135 of an adjacent tile, the end 135 of each tile 113 being also correspondingly chamfered. Apart from the above described differences, the flame tube illustrated in FIG. 3 is of the same construction as that described with reference to FIGS. 1 and 2.

With regard to the embodiment of FIG. 3, it will be seen that the tiles 112 and 113 are, in this embodiment, floating tiles in that pivoting thereof about their respective tongue and groove attachments is permitted. It is believed that this form of construction accommodates radial expansion and contraction of the casing walls 114 and 115 rather better than the tile construction illustrated in FIGS. 1 and 2. The reason for offsetting the tongues 116 and 117 from the centre line of the respective tiles 112 and 113 is that there is less chance of the tiles being rocked about their pivot points during use since a pressure differential which will always occur between the fronts and the backs of the tiles will cause the tiles to adopt one position due to the differential areas of tile on opposite sides of the pivot axis of each tile.

Figure 4:
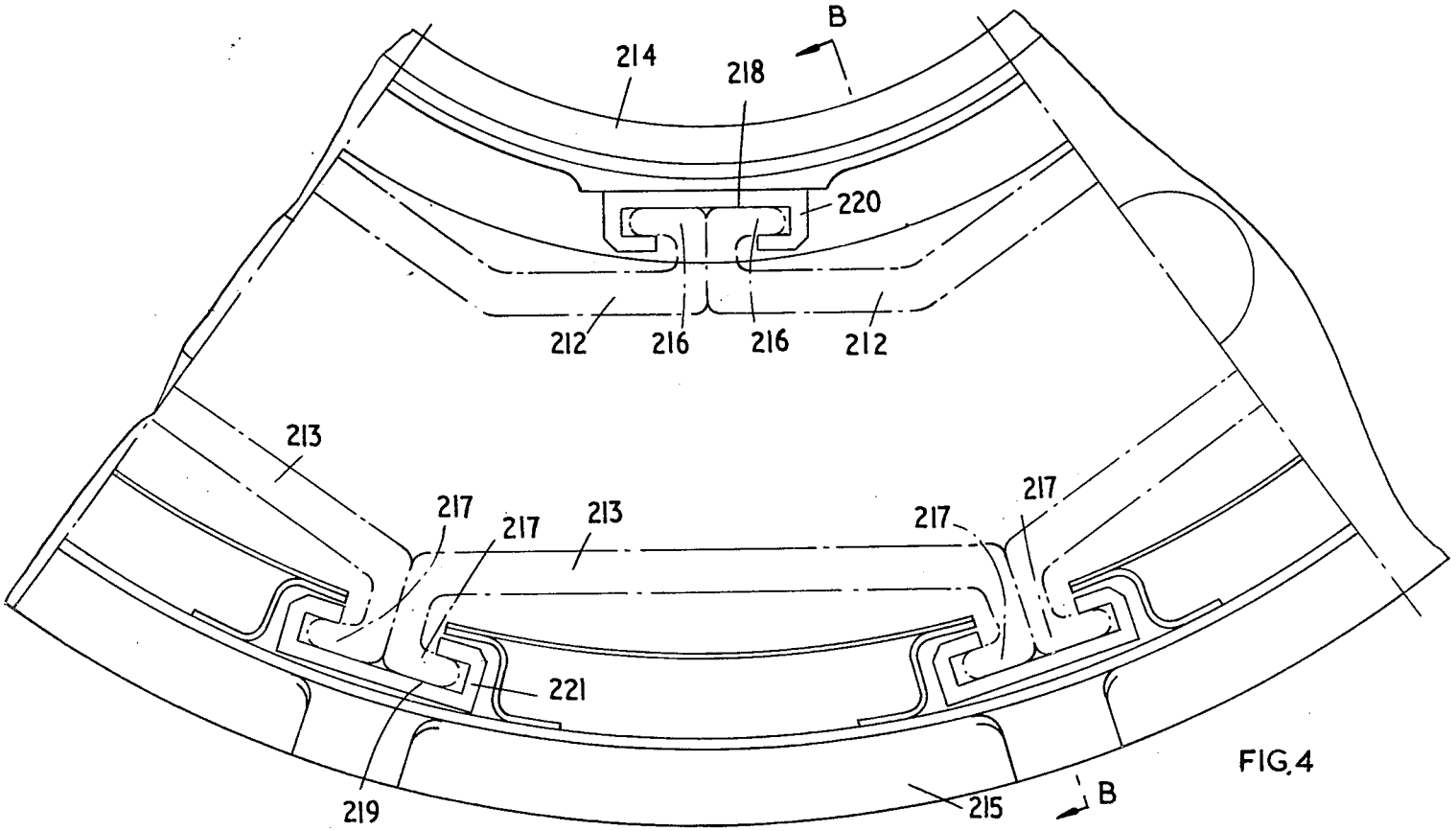
FIG. 4 is a part cut away end view of part of another form of annular flame tube according to the present invention.
Figure 5:
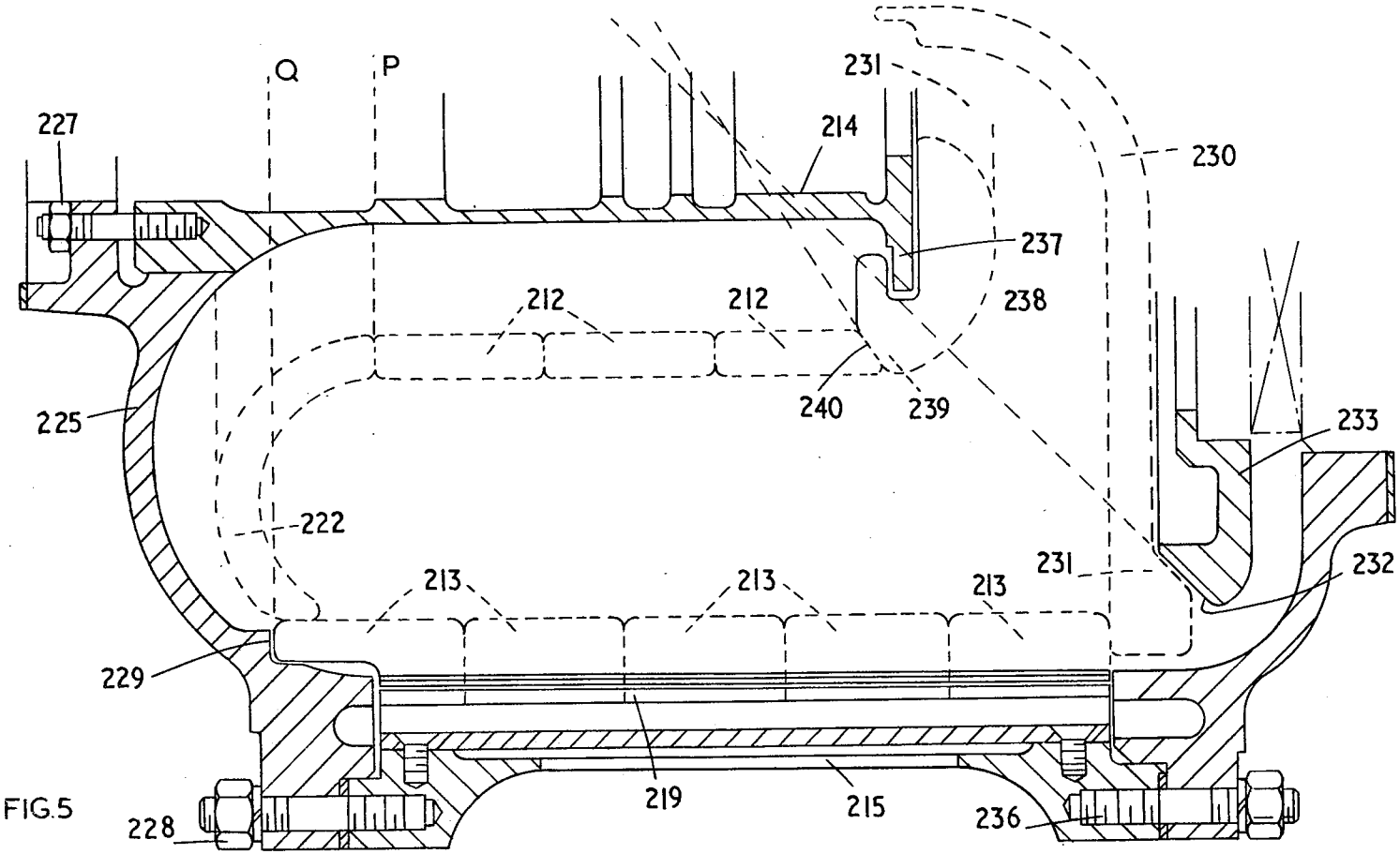
FIG. 5 is a cross-section on the line B—B of FIG. 4.
Figure 6:
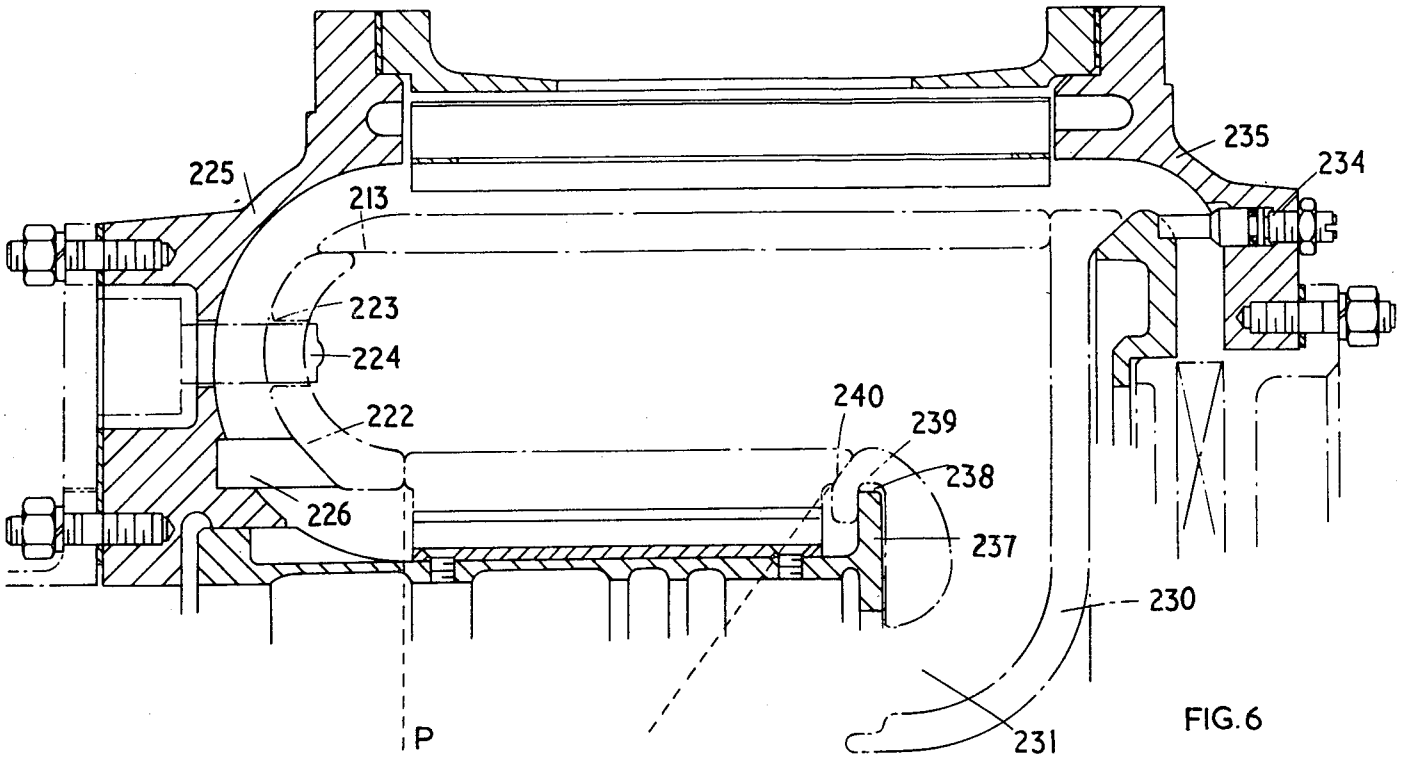
FIG. 6 is a cross-section, similar to FIG. 5 of another part of the flame tube.

Referring now to FIGS. 4 to 6 of the drawings, the flame tube illustrated therein is similar to those of FIGS. 1 to 3 in that inner and outer rows of tiles 212 and 213 of silicon nitride are provided adjacent inside and outside casing walls 214 and 215, respectively. As can be seen in FIG. 4, the tiles 212, 213 are fitted between casing walls 214, 215 so that the tongues 216, 217 engage in respective sets of grooves 218, 219. The adjacent tongues 216, 217 of peripherally adjacent tiles 212, 213 are disposed in different portions of the same groove 218, 219 respectively. This ensures that each tile 212, 213 is closely fitted against its peripherally adjacent neighbour. As in the case of the flame tubes of FIGS. 1 and 2 and FIG. 3, the tiles of each row are engaged in the same grooves. The grooves 218, 219 are defined by metal strips 220, 221 of rebated channel form, said strips 220, 221 being secured to the respective walls 214, 215.

At one end of the rows of tiles 212, 213 there is provided an annular ceramic ring 222 which is of generally C-shaped cross-section and which has a plurality of angularly spaced apertures 223 therethrough (only one shown, see FIG. 6). Each aperture 223 accommodates a fuel atomiser nozzle 224 (only one shown) which is adapted to produce a flat, fan shaped spray pattern. The ceramic ring 222 is supported in position by an end plate 225 through the intermediary of a plurality of support elements 226 (only one shown, FIG. 6). The end plate 225 serves to inter-connect the inner and outer casing walls 214, 215 respectively and is attached by respective bolts 227 and 228 and the pressure applied on ceramic ring 222 by support elements 226 can be varied by appropriate adjustment of bolts 227. Ring 222 and adjacent tiles are in slidable relationship. The outer end . . . of ceramic ring 222 abuts against the inwardly facing surfaces of adjacent outer tiles 213 whilst the inner end of ring 222 abuts against the adjacent ends of adjacent inner tiles 212, the abutment extending over an annulus lying in a plane P which is perpendicular to the longitudinal axis of the annular flame tube. Some of the outer tiles 213 adjacent ring 222 abut against respective shoulders 229 (only one shown, FIG. 5). The engagement between tiles 213 and abutments 229 occurs in a plane Q which lies perpendicular to the longitudinal axis of the flame tube.

At the opposite end of the outer row of tiles 213 there is provided a further annular, ceramic ring 230 which defines the outer wall of an annular outlet 231 of the combustion chamber. The ceramic ring 230 engages, adjacent its outer periphery, against adjacent ends of adjacent tiles 213. On the opposite side of ring 230 to tiles 213, the ring 230 is provided with a frusto-conical surface 231 which is engaged with a corresponding frusto-conical surface 232 on a metal collar 233. The two surfaces 231 and 232 are urged into mutual engagement by means of a series of adjusting screws 234 (only one shown, FIG. 6) engaged with collar 233 and mounted in an end plate 235 which is disposed at the opposite end of the flame tube to end plate 225. The end plate 235 is attached by bolts 236 (only one shown, FIG. 5) to outer casing wall 215. The arrangement of the frusto-conical surfaces 231 and 232 is such than the notional apex thereof intersects the longitudinal axis of the flame tube in plane Q.

The inner casing wall 214 is provided at an end thereof remote from ceramic ring 222 with an annular rim 237. The rim 237 is engaged in an annular recess 238 formed in a composite ceramic ring 239. The composite ring 239 is formed in two halves to enable it to be located around rim 237. The composite ring is of annular form and provided with a frusto-conical surface 240 which engages with chamfered ends of adjacent inner tiles 212. The arrangement of the frusto-conical surface 240 is such that the notional apex thereof intersects the longitudinal axis of the flame tube in plane P. The arrangement of the mutual engaging surfaces 231 and 232, and 239 and 240 with respect to planes P and Q ensure that relative radial expansion and contraction of the casing walls relative to the ceramic tiles is accommodated with a minimum of risk of fracture of the tiles.

The above-described types of flame tube construction have the advantage of limiting the effect of temperature gradients both longitudinally and circumferentially of the flame tube. This effect is due to the formation of the flame tube as a plurality of individual ceramic tiles.

I claim:

1. A flame tube comprising a casing, a plurality of side-by-side ceramic rings disposed in said casing, said rings being constituted by a plurality of ceramic tiles arranged in rows which are aligned longitudinally of said casing, a tongue and groove arrangement between each tile and said casing, said tiles being slidable longitudinally of said casing, abutment means between said casing and one end of each tile row, and clamping means at the opposite end of each tile row, said clamping means urging each said tile row against said abutment means, the flame tube being of annular construction, wherein said ceramic rings are arranged in radially inner and outer rows.

2. The flame tube according to claim 1, wherein two rings of half U-shaped ceramic tiles are provided which interconnect said tiles in said radially inner and outer rows at one end of said radially inner and outer rows, at least some of said half U-shaped ceramic tiles being provided with aligned recesses therein defining apertures therethrough to accommodate fuel atomizer nozzles.

3. The flame tube according to claim 2, wherein said fuel atomizer nozzles are each of a type which produces a fan-shaped spray.

4. The flame tube according to claim 2, wherein said half U-shaped ceramic tiles are located in position by said clamping means, and each said clamping means locates an inner row of said tiles and a corresponding outer row of said tiles.

5. The flame tube according to claim 2, wherein each said abutment means and one od said tiles which is in engagement therewith have mutually contacting surfaces which lie on straight lines emanating from a single point on an axis of the flame tube so that relative longitudinal movement between said rows of tiles and said casing causes said mutually contacting surfaces to slide relative to one another whereby a clamping force applied by said clamping means on said rows of tiles is maintained substantially constant.

6. The flame tube according to claim 1, wherein said radially inner and outer rows are interconnected at one of their ends by an annular ceramic ring having a series of angularly spaced apertures therethrough to receive fuel atomizer nozzles.

7. The flame tube according to claim 6, wherein said fuel atomizer nozzles are each of a type which produces a fan-shaped spray.

8. The flame tube according to claim 6, wherein, at the opposite end of said radially outer row, there is provided a further annular ceramic ring having a curved inner wall defining an outer wall of an annular outlet, and said clamping means acts on said further annular ceramic ring to urge the latter into abutment with said radially outer row.

9. The flame tube according to claim 8, wherein, at the opposite end of said radially inner rowm one of said abutment means is defined by a composite ceramic annulus having an inwardly facing recess engaging around an annular rim on an inner wall of said casing, said abutment means has a frusto-conical tile engaging surface whose notional apex is disposed at a point on an axis of the flame tube, which point being in a plane in which lie said mutually engaging surfaces of said apertured ceramic ring and adjacent tiles of said radially inner row, and said clamping means for said radially inner row acts upon said radially inner row through the intermediary of said apertured annular ceramic ring.

10. The flame tube according to claim 6, wherein said clamping means for said radially outer row comprises a member having a frusto-conical surface engaging the corresponding surface on said further annular ceramic ring, said frusto-conical surface having a notional apex disposed at a point on an axis of the flame tube which is in a plane in which lie said mutually engaging surfaces of said abutment means and adjacent tiles of said radially outer row.

* * * * *